US005597040A

United States Patent [19]

Stout et al.

[11] Patent Number: 5,597,040

[45] Date of Patent: Jan. 28, 1997

[54] COMBINATION GRAVEL PACKING/FRAC APPARATUS FOR USE IN A SUBTERRANEAN WELL BORE

[75] Inventors: Gregg W. Stout, Montgomery, Tex.; James T. Matte, Broussard, La.

[73] Assignee: Western Company of North America, Houston, Tex.

[21] Appl. No.: 291,979

[22] Filed: Aug. 17, 1994

[51] Int. Cl.[6] ..... E21B 43/02

[52] U.S. Cl. ..... 166/51

[58] Field of Search ..... 166/51, 278, 318

[56] References Cited

U.S. PATENT DOCUMENTS

| | | | |
|---|---|---|---|
| 2,299,057 | 10/1942 | McClain | 166/51 |
| 3,987,854 | 10/1976 | Callihan et al. | 166/278 |
| 4,541,486 | 9/1985 | Wetzel et al. | 166/297 |
| 4,606,408 | 8/1986 | Zunkel et al. | 166/278 |
| 4,627,488 | 12/1986 | Szarka | 166/51 |
| 4,638,859 | 1/1987 | Zunkel et al. | 166/51 |
| 4,733,723 | 3/1988 | Callegari, Sr. | 166/318 X |
| 4,944,348 | 9/1990 | Whiteley et al. | 166/278 |

*Primary Examiner*—Hoang C. Dang
*Attorney, Agent, or Firm*—Arnold, White & Durkee

[57] ABSTRACT

An apparatus is disclosed for fracing and gravel packing a subterranean well. The apparatus includes a packer and a liner assembly with a setting tool and crossover assembly. Abrasive wear in the wall of the crossover assembly is abated by providing for conversion of turbulent fluid flow of the fracing or gravel packing fluid into laminar flow immediate the opening within the crossover tool between the interior of the crossover tool and the exterior thereof. An isolator is also provided within the crossover such that when it is opened, a valve head is completely shielded and carried within the device whereby further cutting of the crossover tool wall by fluid flow is greatly abated.

5 Claims, 5 Drawing Sheets

FIG. 2
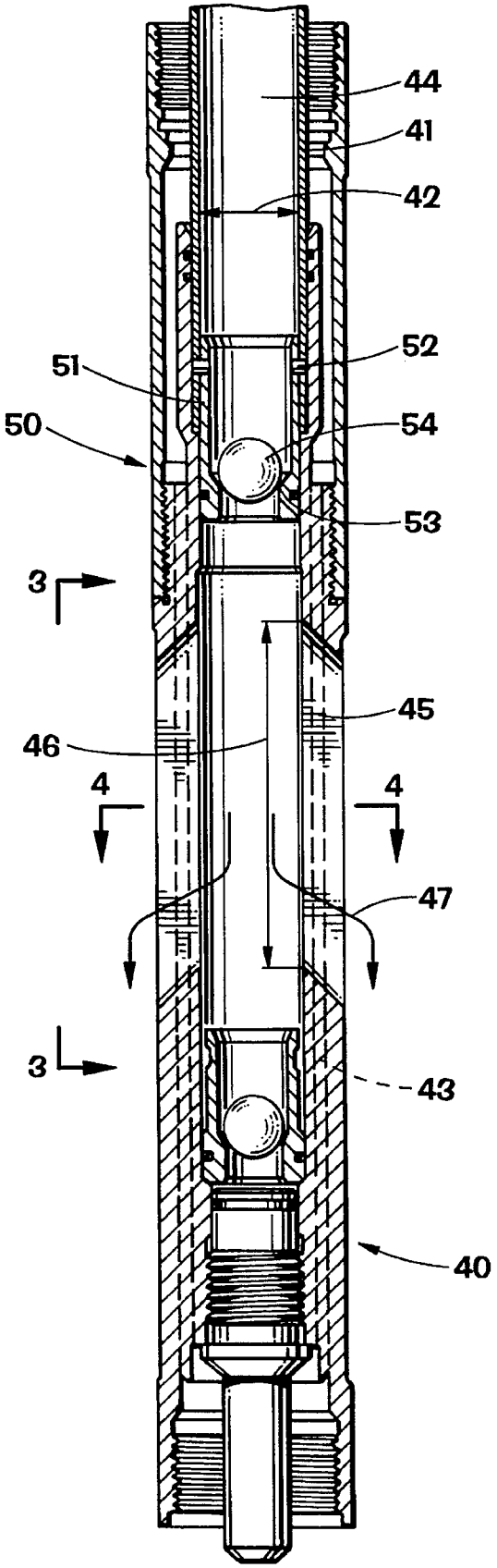
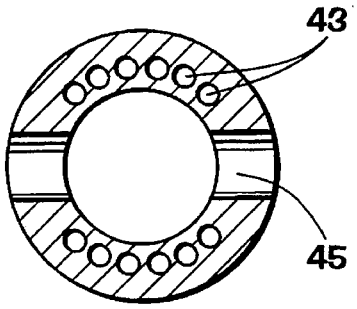
FIG. 4
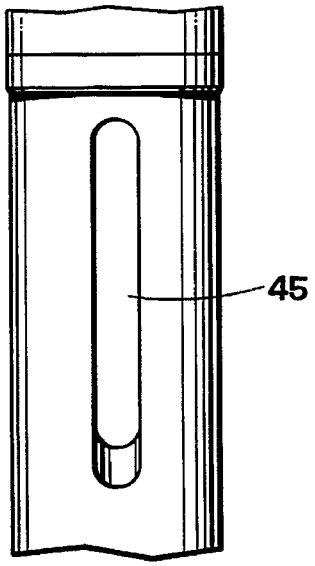
FIG. 3

COMBINATION GRAVEL PACKING/FRAC APPARATUS FOR USE IN A SUBTERRANEAN WELL BORE

BACKGROUND OF THE INVENTION

1. Field of the Invention

The invention relates to a combination fracing and gravel packing assembly for use in a subterranean well.

2. Brief Description of the Prior Art

Subsequent to the drilling of the subterranean oil or gas well, casing is typically set and is perforated in conventional fashion. A fracing fluid may then be injected under pressure through the perforations into the production zone to break up the formation to open up or provide fractures within the zone to permit more efficient production of the well therethrough.

Unconsolidated formations, particularly those containing loose sands and sandstone strata, present problems in well production due to migration of loose sands and degraded sandstone into the well bore after fracturing or as the formation deteriorates under the pressure and flow of fluids therethrough during normal production of the well. Such migration of particles may eventually clog the flow passages in the production system of the well, and can seriously erode the equipment. In some instances, the clogging of the production system may lead to a complete termination of flow, or killing of the well.

One method of controlling sand migration into a well bore consists of placing a pack of gravel on the exterior of a perforated or slotted liner or screen which is positioned across an unconsolidated formation to present a barrier to the migrating sand from that formation while still permitting fluid flow thereacross. The gravel is carried to the formation in the form of a slurry, and the carrier fluid being removed and returned to the surface. The proper size of gravel must be employed to effectively halt sand migration through the pack, the apertures of the liner or screen being gauged so that the gravel will settle out on its exterior, with the slurry fluid carrying the gravel entering the liner or screen from its exterior and being circulated back to the surface.

Prior to effecting the gravel pack, drilling mud and other contaminants may be washed from the well bore, and the formation treated, such as by fracing the well, as above described.

Subsequent to effecting the gravel pack, a reverse circulation technique may be utilized to remove remaining gravel and in slurry from the operating string utilized to conduct the slurry. With such a reverse circulation technique, the direction of circulation is reversed and a clean fluid is pumped down the path previously utilized for returning the slurry fluid, and the remaining gravel and slurry will be forced back up the path originally used to conduct the gravel and slurry down to the well.

Typical gravel packing and fracing devices and methods are shown in the prior art, such as in U.S. Pat. Nos. 3,987,854, entitled "Gravel Packing Apparatus And Method"; 4,606,408, entitled "Method And Apparatus For Gravel Packing A Well"; and 4,627,488, entitled "Isolation Gravel Packer". Such typical and other prior art gravel packing assemblies contain a crossover assembly which permits fluid to be introduced downwardly within the work string or tubular conduit upon which the packer is carried, with the fluid being disposed out of the crossover tool and into a fluid flow path exterior of the liner assembly and into the annular area in the well between the liner assembly and the casing. The crossover tool also has intermittently spaced fluid return flow paths therein which are offset from the ports or openings within the crossover tool opening into the liner assembly.

It has been observed in such prior art and devices that the turbulence within the downwardly flowing gravel packing or fracing of fluid will result in an actual cutting of the internal wall of the crossover assembly directly into the return fluid flow paths in the device such that planned fluid flow integrity is lost and a circulation path is unintentionally established directing such fluids through the crossover assembly interior and outwardly thereof within the area between the crossover assembly and the liner, around the packer and within the tubing/casing annulus above the packer, to the top of the well. When this problem is encountered, the well must be completely closed in and the work string, packer, and liner assembly with the crossover therein must be completely withdrawn from the well and replaced. This results in considerable down time and extra rig time being utilized.

In particular, many such prior art devices incorporate a hydraulic setting mechanism for the packer which requires that the interior of the crossover assembly above, or upstream, of the crossover ports be isolated from the interior of the assembly and the work string. Such is effected by providing a selectively releasable sliding sleeve defining a valve seat thereon. When it is desired to hydraulically set such packer, a spherical element, such as a ball, is gravitated or pumped through the work string until it sealingly rests upon the valve seat. Thereafter, pressure within the work string is increased and the packer is set. After testing of the integrity of the seated packer, the pressure is increased and a sliding sleeve is caused to be shearably released from the interior of the crossover assembly and it is shifted downwardly and below, or downstream of the crossover ports. Such prior art combination valve head and seat assemblies thus permit the valve head, or ball, to be sealingly held above and on the upper end of the sleeve, whereby the exterior of the ball is exposed to the flow of the fracing and/or gravel packing fluids. The ball, having an outer diameter which is less than the inner diameter of the inner wall of the crossover assembly, will "chatter" or move upon its seat, as the turbulent fluid within the crossover assembly and the work string changes direction to enter into the crossover port. The constant hard contact of the ball against the crossover wall has been found to also result in abrasion of the wall and thereby cutting a hole within such wall to expose the interior of the crossover assembly to the fluid flow return paths within the crossover assembly, thus directly communicating the downwardly flowing fluid with an upwardly exposed fluid flow path at a time when same is not desired.

Turbulent fluid effects upon gravel packing systems during frac/pack operations is discussed to some extent in paper no. 22857 of the Society of Petroleum Engineers entitled "Study Of Effects Upon Gravel-Pack Systems During Frac/Pack Operations", (1991).

The present invention is directed to abating the problems discussed above in the prior art assemblies.

SUMMARY OF THE INVENTION

The present invention provides a combination gravel packing/frac apparatus for use in a subterranean well bore. The apparatus is adapted to be introduced into the well bore on a tubular conduit for circulating fluid into and from the well bore when the apparatus is in one position and for placing particulate matter transmitted within the fluid from the top of the well to around the exterior of the apparatus when the apparatus is in another position. The apparatus comprises a packer assembly and an exterior liner assembly extending from the packer assembly. A perforated tubular section is also provided together with crossover means which are releasably secured to the packer assembly and which also extend into the liner assembly.

The crossover means provides a cylindrical conduit having a fluid flow area thereacross which is communicable to the tubular conduit to form a fluid flow passage therein to and from the top of the well. Crossover port means have a fluid flow area thereacross through the cylindrical conduit which selectively provide a fluid flow path between the interior of the cylindrical conduit and the interior of the liner assembly. Means are provided for selectively isolating the fluid flow path from the interior of the cylindrical conduit with the flow area across the crossover port means being sufficient to convert turbulent fluid flow directed downwardly through the tubular conduit into laminar fluid flow within at least a section of the cylindrical conduit above, or upstream, of the crossover ports.

The invention also includes isolation means having a slidable sleeve selectively and initially secured to the interior of the cylindrical conduit. The sleeve defines a valve seat thereon for sealing receipt of a spherical valve head, such as a ball, for sealing engagement thereon and which is pumpable through the tubular conduit from the top of the well. Securing means are provided for initially securing the slidable sleeve to the cylindrical conduit and which are responsive to increased pressure within the tubular conduit and the cylindrical conduit to release the sleeve from the secured position to thereby carry the spherical valve head completely within the sleeve and within the cylindrical conduit to a second position whereby, when the sleeve and the ball are in a second position, the sleeve and the valve head permit fluid communication between the crossover port means and the interior of the tubular conduit, with the ball element being completely shielded within the interior of the sliding sleeve element.

BRIEF DESCRIPTION OF THE DRAWINGS

FIG. 2 is a view similar to that of FIG. 1, showing the apparatus of the present invention.

FIG. 3 is a cross-sectional view taken along lines 3—3 of FIG. 2.

FIG. 4 is a cross-sectional view of the assembly of FIG. 2 taken along lines 4—4 of FIG. 2.

DESCRIPTION OF THE PREFERRED EMBODIMENTS

Figure 1:
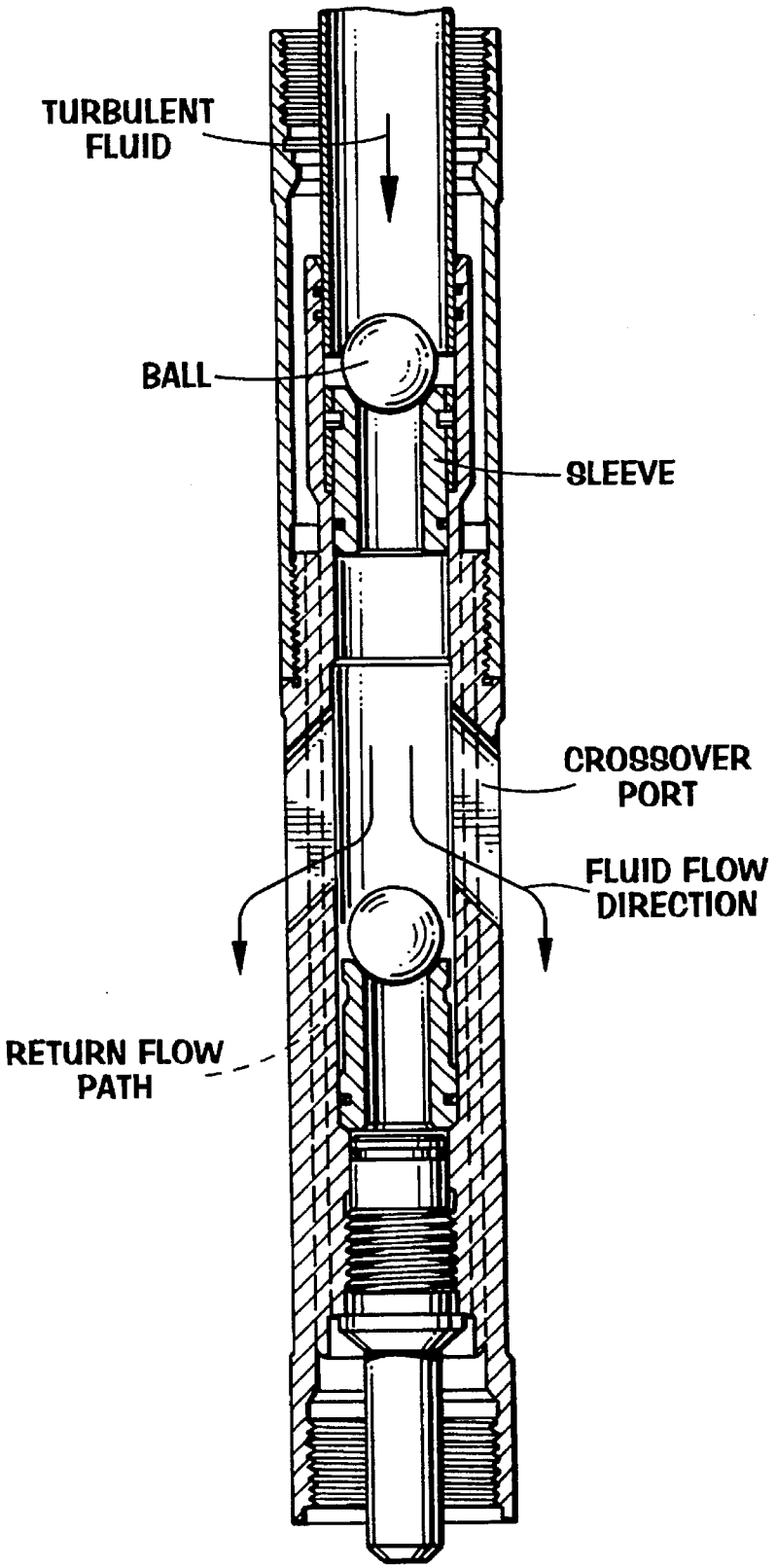
FIG. 1 (PRIOR ART)
FIG. 1 is a vertically extending half sectional view of a typical prior art crossover assembly with the valve head and valve seat shown in original or initially secured, position, as well as in the second or open position above typically constructed crossover ports through the crossover assembly and the liner.

With first reference to FIG. 1, there is shown a typical prior art gravel packing/fracing crossover and liner assembly at the point where the ports within the crossover assembly permit downwardly directed fluid flow from within the crossover assembly to the exterior of the liner assembly within the annulus area between the liner and the casing wall. Application of hydraulic pressure down the tubing shears the ball and seat to the lower position. This is done before pumping a gravel packing and/or frac fluid (FIG. 1), with the prior art ball assembly being held in sealing position upon and around the top of the sleeve. In the lower position, the ball is directly exposed to the turbulent fluid passing thereacross and into the crossover ports. Such turbulence has been found to cause the ball to actually chatter and hit or eat against the wall of the crossover assembly laterally thereof and/or cause the slurry with proppant to deflect towards the inside of the crossover to cause abrasive wear, resulting in a loss of integrity of the various fluid flow paths desired. Additionally, as shown in FIG. 1, the prior art has also provided a typical crossover port which, in effect, causes the turbulent fluid passing downwardly within the interior of the crossover assembly to radically change directions as it passes through and across the crossover assembly and the liner assembly.

Figure 5:
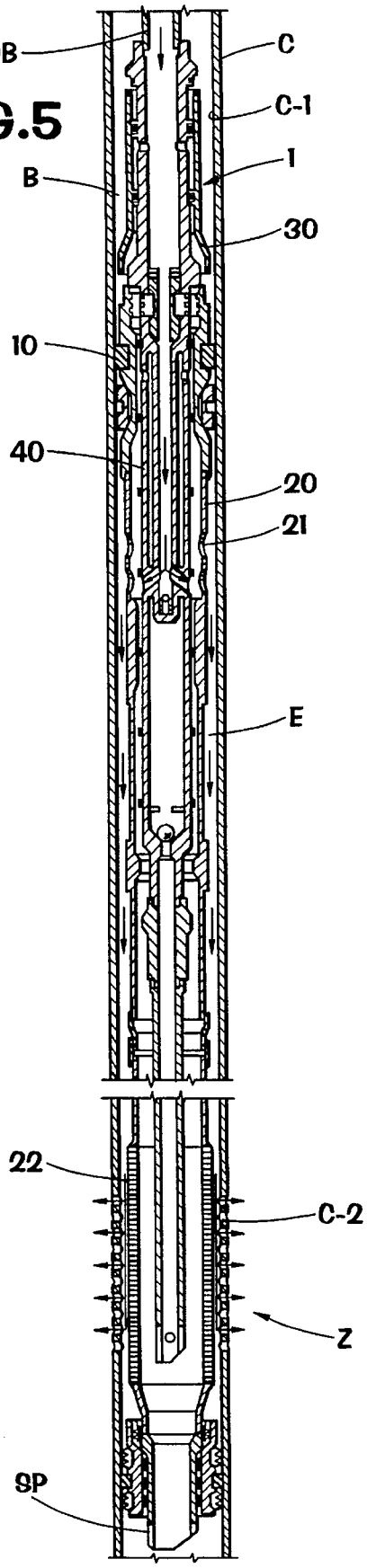
FIG. 5 is a vertical schematic illustration of the assembly of the present invention illustrating the position of the devices and the fluid flow path of fracing fluid as it is squeezed into a production zone within the well.

Now referring to FIG. 5, there is shown the apparatus 1 of the present invention being carried into the well bore B on a tubular conduit D. The apparatus comprises a packer assembly 10 (shown in set position) as well as a setting tool 30 thereabove. An elongated liner assembly 20 is carried by and secured lowerly of the packer 10 and includes a number of radially extending ports 21 therein which fluidly communicate the interior of the liner 20 with the exterior, or annulus E defined between the exterior of the liner 20 and the casing C.

As shown, the casing C has been set in the well subsequent to drilling, and has been perforated by perforations C-2 through the zone Z, at the desired depth.

The liner 20 also has somewhat lowerly of the ports 21 a perforated tubular section which may be provided in the form of a screen. The lower end of the liner 20 is stabbed into a sump packer SP during run-in of the tubular conduit D prior to the setting of the packer 10.

The apparatus 1 also includes a crossover assembly 40, which is more particularized as shown in FIG. 2. The crossover assembly contains a cylindrical conduit 41 which is in fluid communication with the interior of the tubular conduit D by means of a fluid flow passage 44 therein. The cylindrical conduit 41 provides a fluid flow area 42 defined as the radial area across the conduit 41, which is always open.

Preferably, the crossover assembly 40 of the apparatus 1 will include a selective isolation means 50. The isolation means 50 contains a slidable sleeve 51 which is initially held in secured position by means of shear pins 52 relative to the cylindrical conduit 41 just upstream, or above the crossover ports. The slidable sleeve 51 provides a circumferentially extending smooth valve seat area 53 for sealing eraplacement thereon of a pumpable or gravitionally directed valve head element, such as ball 54, when it is desired to either set the packer 10, and/or to open the crossover ports 45 for communication of the fluid flow passage 44 with the exterior of the liner assembly 20.

After the ball valve head 54 is sealingly engaged upon the seat 53, pressure within the tubular conduit D is increased at the top of the well until such time as the strength of the shear pin 52 is exceeded and such pin will break, permitting disengagement of the slidable sleeve 51 from the cylindrical conduit 41. The slidable sleeve 51 now shifts downwardly within the crossover assembly to the position as shown in the lowermost portion of FIG. 2.

It will be appreciated, particularly when one compares the design of the selective isolation means 50 as shown in FIG. 2 with the prior art design as shown in FIG. 1, that the valve head 54 is completely surrounded by and is carried within the slidable sleeve 51 of the selective isolation means 50. This design does permit an additional buffer or protective sleeve to further abate abrasion of the inner smooth wall of the cylindrical conduit 41 just laterally of the shifted slidable sleeve 51 within the crossover assembly 40. As shown in this open position in FIG. 2, crossover ports 45 provide a fluid flow path 47 in communication with the fluid flow passage 44, and laminar fluid flow area 46 is thus provided. The return flow paths 43 through the crossover assembly 40 retain their integrity.

Accordingly, the enlargements of the crossover ports 45 defining the fluid flow area of 46 will be considerably larger than the fluid flow area of 42 at the point of the change of direction of the fluid flow passing downwardly within the crossover means 40 and into the exterior of the liner assembly 20. The enlargements of the crossover ports 45 should be at least about three times larger than the flow area 42, and, preferably, about five times larger. Thus, at such point, turbulent fluid flow within the fluid flow passage 44 has been converted to laminar fluid flow through the crossover ports 45, thus greatly abating the tendency of such fluid to abrasively erode or otherwise deleteriously effect the integrity between the return flow path 44 within the crossover assembly 40 and the crossover ports 45 from within the interior of the crossover assembly to the exterior of the liner 20.

Now with respect to the views illustrated in FIGS. 5–8, the apparatus 1 of the present invention is shown in the squeezing position FIG. 5, with the valve head 54 upon its valve seat and shifted into lower position to prevent fluid flow from the top of the well downwardly within the crossover assembly 40 and out the crossover ports 45 to flow exteriorly of the perforated tubular section 22 and into the perforation seat 2 of the zone Z to squeeze the fracturing fluid into the zone Z.

Figure 6:
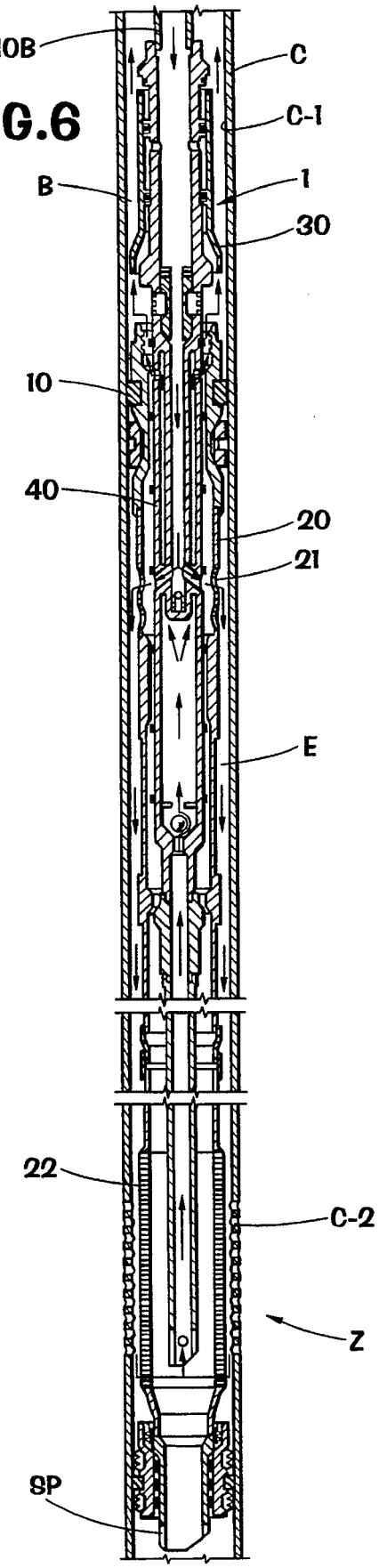
FIG. 6 is a view similar to that of FIG. 5, illustrating the position of the components of the assembly and the fluid flow path during circulation of the fluid in the well for clean out purposes.

Thereafter, fluid or frac slurry may be circulated in the tubular conduit D after pick up of the setting tool 30 relative to the packer assembly 10 to permit exposure of return fluid flow ports interior of the packer 10 so that fluid now flows in a flow path as indicated by the arrows in FIG. 6. Fracing prior to gravel packing may be done in either the squeeze position or in the circulating position.

Figure 7:
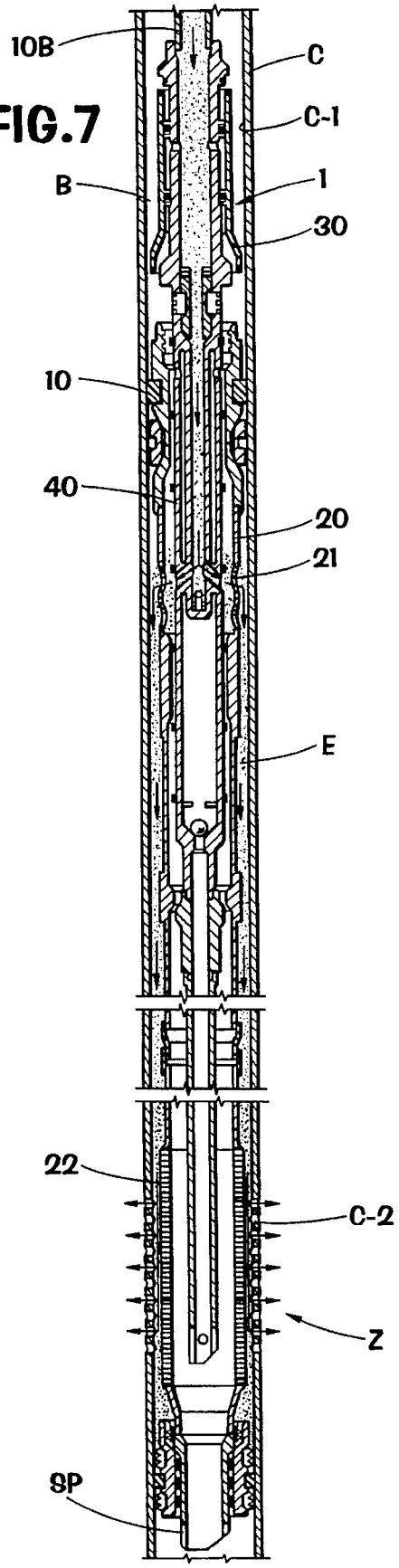
FIG. 7 is a view similar to that of FIGS. 5 and 6, illustrating the position of the components during frac circulation or gravel packing of the well.
Figure 8:
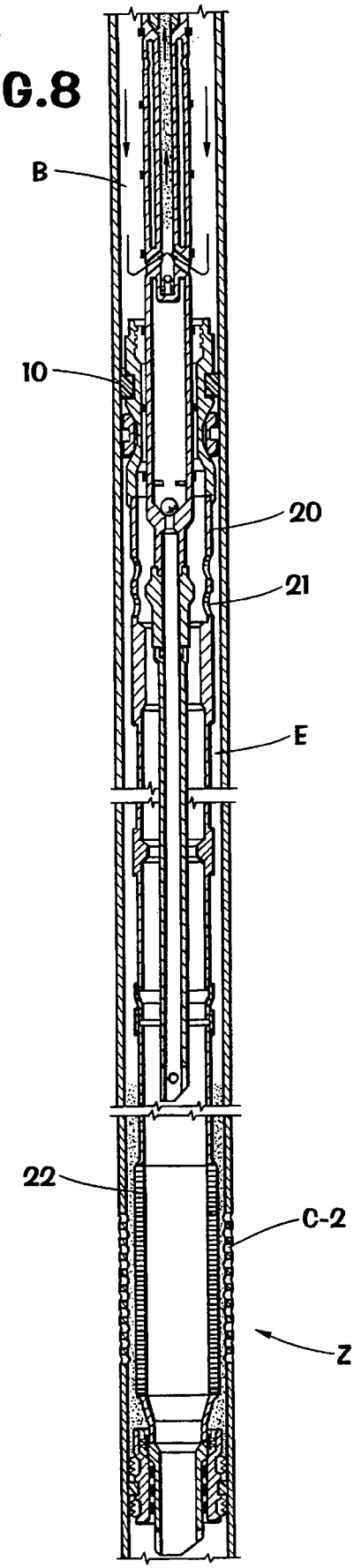
FIG. 8 is a view similar to those of FIGS. 5–7, illustrating the positioning of the tool and the flow of fluid subsequent to gravel packing.
Figure 9:
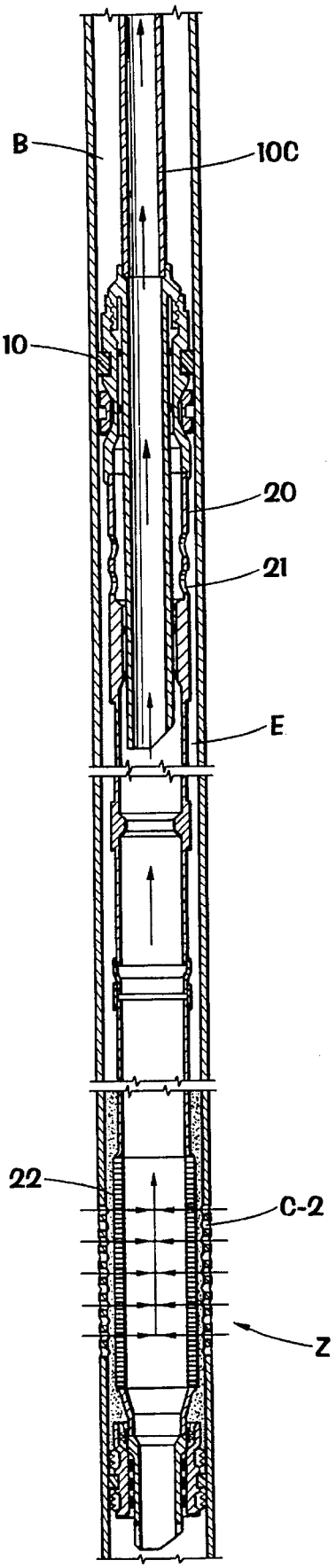
FIG. 9 is a view similar to those of FIGS. 5–8, illustrating the retrieval of the work string carrying the crossover assembly of the present invention, leaving the packer and liner assembly in place with production tubing being introduced within the packer for actual production of the well.

Thereafter, as illustrated in FIG. 7, gravel may be carried in a gravel packing fluid interior of the tubular conduit D, out the crossover ports 45 and packed exteriorly of the perforated tubular section 22, with return of fluid without the gravel which passes interior of the perforated tubular section 22, as shown in FIG. 6. Washouts may then be effected by placing the apparatus 1 and the tubular conduit D in the reverse position, as shown in FIG. 8. Thereafter, the entire tubular conduit D carrying the crossover assembly 40 is removed from within the seated packer 10 carrying the liner 20 to the top of the well and production conduit is thereafter stabbed into sealing engagement within the interior of the packer 10 for production of the well through the perforations C-2 and interior of the liner assembly 20, to the top of the well.

Although the invention has been described in terms of specified embodiments which have been set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed desired to be secured by Letters Patent is:

1. A combination gravel packing/frac apparatus for use in a subterranean well bore and adapted to be introduced into the well bore on a tubular conduit for circulating fluid into and from the well bore when said apparatus is in one position and for placing particulate matter transmitted within said fluid from the top of the well to around the exterior of said apparatus when said apparatus is in another position, said apparatus comprising:

a packer assembly;

an exterior liner assembly extending from said packer assembly and including a perforated tubular section; and crossover means releasably secured to said packer assembly and extending into said liner assembly, said crossover means including:

a cylindrical conduit having a fluid flow area thereacross and communicable to said tubular conduit to form a fluid flow passage;

crossover port means having a fluid flow area thereacross through said cylindrical conduit and selectively providing a fluid flow path between the interior of the cylindrical conduit and the interior of the liner assembly; and means for selectively isolating said fluid flow path from the interior of said cylindrical conduit, the flow area across said crossover port means being at least about three times the flow area across said cylindrical conduit.

2. The apparatus of claim 1 wherein said means for selectively isolating said fluid flow path further comprises a slidable sleeve selectively and initially secured to the interior of said cylindrical conduit, said sleeve defining a valve seat thereon for sealing receipt of a spherical valve head for sealing engagement thereon and pumpable through said tubular conduit; and securing means for initially securing said slidable sleeve to said cylindrical conduit and responsive to pressure within said tubular conduit and said cylindrical conduit to release said sleeve from said secured position to thereby carry said spherical valve head completely within said sleeve and within said cylindrical conduit to a second position whereby, when in such second position, said sleeve and said valve head permit fluid communication between said crossover port means and the interior of said tubular conduit.

3. A combination gravel packing/frac apparatus for use in a subterranean well bore and adapted to be introduced into the well bore on a tubular conduit for circulating fluid into and from the well bore when said apparatus is in one position and for placing particulate matter transmitted within said fluid from the top of the well to around the exterior of said apparatus when said apparatus is in another position, said apparatus comprising:

a packer assembly;

an exterior liner assembly extending from said packer assembly and including a perforated tubular section; and crossover means releasably secured to said packer assembly and extending into said liner assembly, said crossover means including:

a cylindrical conduit having a fluid flow area thereacross and communicable to said tubular conduit to form a fluid flow passage;

crossover port means having a fluid flow area thereacross through said cylindrical conduit and selectively providing a fluid flow path between the interior of the cylindrical conduit and the interior of the liner assembly, said crossover port means including means to convert turbulent fluid flow directed downwardly through said cylindrical conduit into laminar fluid flow within at least a portion of said cylindrical conduit.

4. The apparatus of claim 3 further comprising:

isolation means including a slidable sleeve selectively and initially secured to the interior of said cylindrical conduit, said sleeve defining a valve seat therein for sealing receipt of a spherical valve head for sealing engagement thereon and pumpable through said tubular conduit; and securing means for initially securing said slidable sleeve to said cylindrical conduit and responsive to pressure within said tubular conduit and said cylindrical conduit to release said sleeve from said secured position to thereby carry said spherical valve head completely within said sleeve and within said cylindrical conduit to a second position whereby, when in said second position, said sleeve and said valve head permit fluid communication between said crossover port means and the interior of said tubular conduit.

5. A combination gravel packing/frac apparatus for use in a subterranean well bore and adapted to be introduced into the well bore on a tubular conduit for circulating fluid into and from the well bore when said apparatus is in one position and for placing particulate matter transmitted within said fluid from the top of the well to around the exterior of said apparatus when said apparatus is in another position, said apparatus comprising:

a packer assembly;

an exterior liner assembly extending from said packer assembly and including a perforated tubular section; and crossover means releasably secured to said packer assembly and extending into said liner assembly, said crossover means including:

a cylindrical conduit having a fluid flow area thereacross and communicable to said tubular conduit to form a fluid flow passage;

crossover port means having a fluid flow area thereacross through said cylindrical conduit and selectively providing a fluid flow path between the interior of the cylindrical conduit and the interior of the liner assembly; and means for selectively isolating said fluid flow path from the interior of said cylindrical conduit, the flow area across said crossover port means being at least about five times the flow area across said cylindrical conduit.

* * * * *